United States Patent [19]

Inoue et al.

[11] 4,329,843

[45] May 18, 1982

[54] EXHAUST PASSAGE SYSTEM OF SIX CYLINDER ENGINES

[75] Inventors: Kazuo Inoue, Tokyo; Hiroshi Kogure, Tokorozawa, both of Japan

[73] Assignee: Honda Giken Kogyo Kabushiki Kaisha, Tokyo, Japan

[21] Appl. No.: 175,716

[22] Filed: Aug. 6, 1980

Related U.S. Application Data

[63] Continuation of Ser. No. 729,945, Oct. 6, 1976, abandoned, and Ser. No. 932,457, Aug. 10, 1978, abandoned.

[30] Foreign Application Priority Data

Oct. 8, 1975 [JP] Japan ..... 50-121231
Oct. 21, 1975 [JP] Japan ..... 50-125938

[51] Int. Cl.[3] ..... F01N 3/24; F01N 7/10

[52] U.S. Cl. ..... 60/274; 60/282; 60/323; 123/59 A

[58] Field of Search ..... 60/282, 323, 274; 123/59 B, 59 R, 59 A

[56] References Cited

U.S. PATENT DOCUMENTS

| | | | |
|---|---|---|---|
| 3,413,803 | 12/1968 | Rosenlund | 60/282 |
| 3,934,411 | 1/1976 | Masaki | 60/282 |
| 3,938,330 | 2/1976 | Nakajima | 60/282 |
| 3,947,545 | 3/1976 | Ishida | 60/282 |
| 3,990,234 | 11/1976 | Kajitani | 60/282 |

FOREIGN PATENT DOCUMENTS

| | | | |
|---|---|---|---|
| 571525 | 8/1945 | United Kingdom | 123/59 B |

OTHER PUBLICATIONS

Lichty, L. C., *Internal Combustion Engines*, p. 350.

*Primary Examiner*—Douglas Hart
*Attorney, Agent, or Firm*—Lyon & Lyon

[57] ABSTRACT

A six cylinder internal combustion engine having first and second groups of three adjacent combustion chambers and an exhaust valve port connected to each of the six combustion chambers. In each group of three adjacent combustion chambers the exhaust valve ports of the side combustion chambers are positioned on the side of the middle combustion chamber thereby reducing the length and surface area of the exhaust passages and maintaining a high exhaust temperature. First and second confluence members join the exhaust valve ports of the first and second groups of three adjacent combustion chambers respectively to an exhaust reaction chamber.

The ignition timing of the combustion chambers is controlled in order that the periods of successive exhaust valve port openings partially overlap. This allows the cooler gases at the end of the exhaust stroke to be heated by the hot gases produced at the ignition of the next successive combustion chamber exhaust stroke which further maintains a high exhaust temperature in the exhaust reaction chamber.

14 Claims, 10 Drawing Figures

FIG. 5.
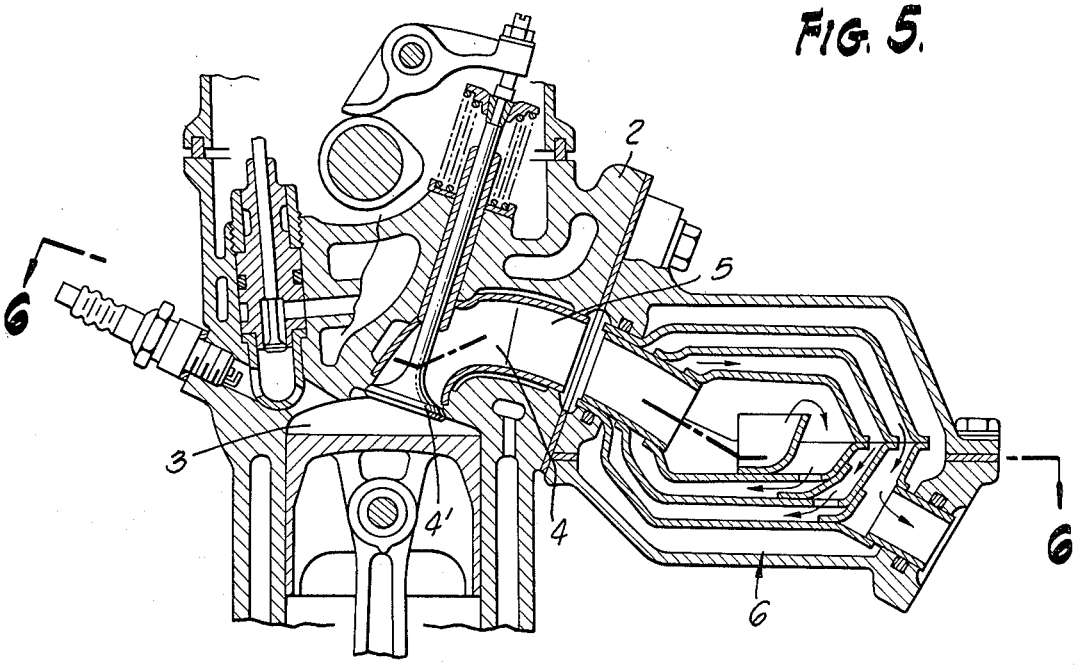
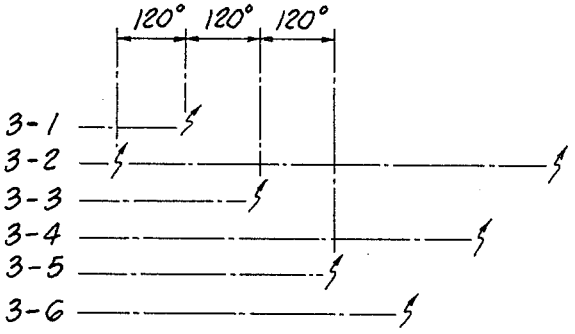
FIG. 7.

EXHAUST PASSAGE SYSTEM OF SIX CYLINDER ENGINES

This is a continuation of application Ser. No. 729,945, filed Oct. 6, 1976 and Ser. No. 932,457, filed Aug. 10, 1978, both now abandoned.

The present invention is related to an exhaust passage system for a six cylinder engine.

It is well known that in order to improve the efficiency of exhaust reaction in six cylinder engines it is desirable to join the exhaust gases from each combustion chamber at an early time. FIG. 1 illustrates six exhaust passages "b" connected to exhaust valve ports "a" and meeting one another in an engine "c". FIG. 2 illustrates exhaust passages "b" positioned to meet within an engine "c" between each adjacent group of two combustion chambers. This joinder of the exhaust passages "b" is then connected to a single common exhaust reaction chamber "d".

Such configurations as shown in FIGS. 1 and 2, are undesirable because of the fact that the outermost exhaust passages "b", being the longest in length, cause the exhaust gases flowing therethrough to radiate heat and thereby reduce the temperature of the exhaust gases prior to entering an exhaust reaction chamber. Such a decrease in temperature substantially decreases the reaction occurring within the reaction chamber. The exhaust systems of FIGS. 1 and 2 also have the disadvantage that the total surface area of the exhaust passages is large, thus increasing the undesirable cooling of the exhaust gases through radiant heat transfer.

Furthermore, adjacent combustion chambers whose exhaust gases are joined, are generally separated from each other in ignition timing. As will be discussed later, this ignition timing also decreases the exhaust gas temperature in the exhaust reaction chamber.

An object of this invention is to provide an improved exhaust passage system for a six cylinder internal combustion engine. Other objects become apparent upon a reading of the entire specification including the drawings and claims.

The present invention provides for an improved exhaust passage system for a six cylinder internal combustion engine wherein first and second groups of three adjacent combustion chambers are provided, each of the combustion chambers having an exhaust valve port. In both the first and second groups of three adjacent combustion chambers, the exhaust valve ports of the side combustion chambers are positioned toward the side of the middle chamber in order to reduce the length and surface area of the exhaust passages from the exhaust port to an exhaust reaction chamber.

In a preferred embodiment, the ignition timing of the combustion chambers in the first and second group of three adjacent combustion chambers is controlled in order that the periods of successive exhaust valve port openings partially overlap. Such ignition timing allows cooler gases discharged from a combustion chamber at the end of the exhaust stroke to be heated by hot gases produced at the initiation of the next successive combustion chamber exhaust stroke thereby further maintaining a high exhaust temperature in the exhaust reaction chamber and promoting increased reaction effectiveness in the exhaust reaction chamber.

FIG. 5 is a cross-sectional view of another embodiment of the present invention.

FIG. 7 is a diagram illustrating the firing order of the combustion chambers of the present invention.

Figure 1:
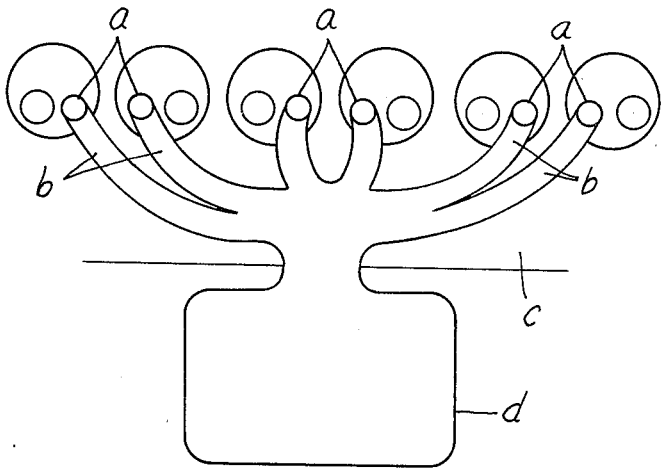
FIGS. 1 and 2 are schematic representations of known exhaust passage systems for six cylinder engines.
Figure 2:
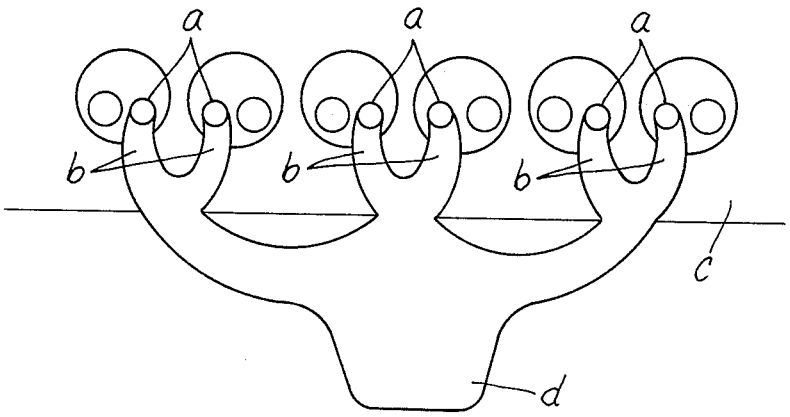
Figure 3:
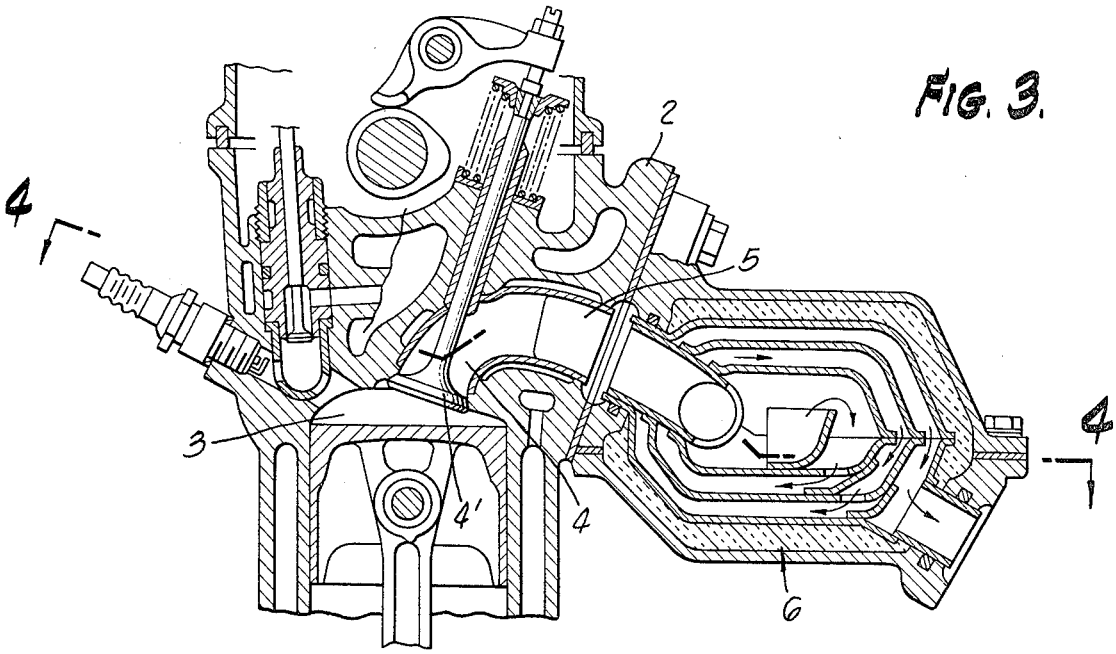
FIG. 3 is a cross-sectional side view illustrating the present invention.
Figure 4:
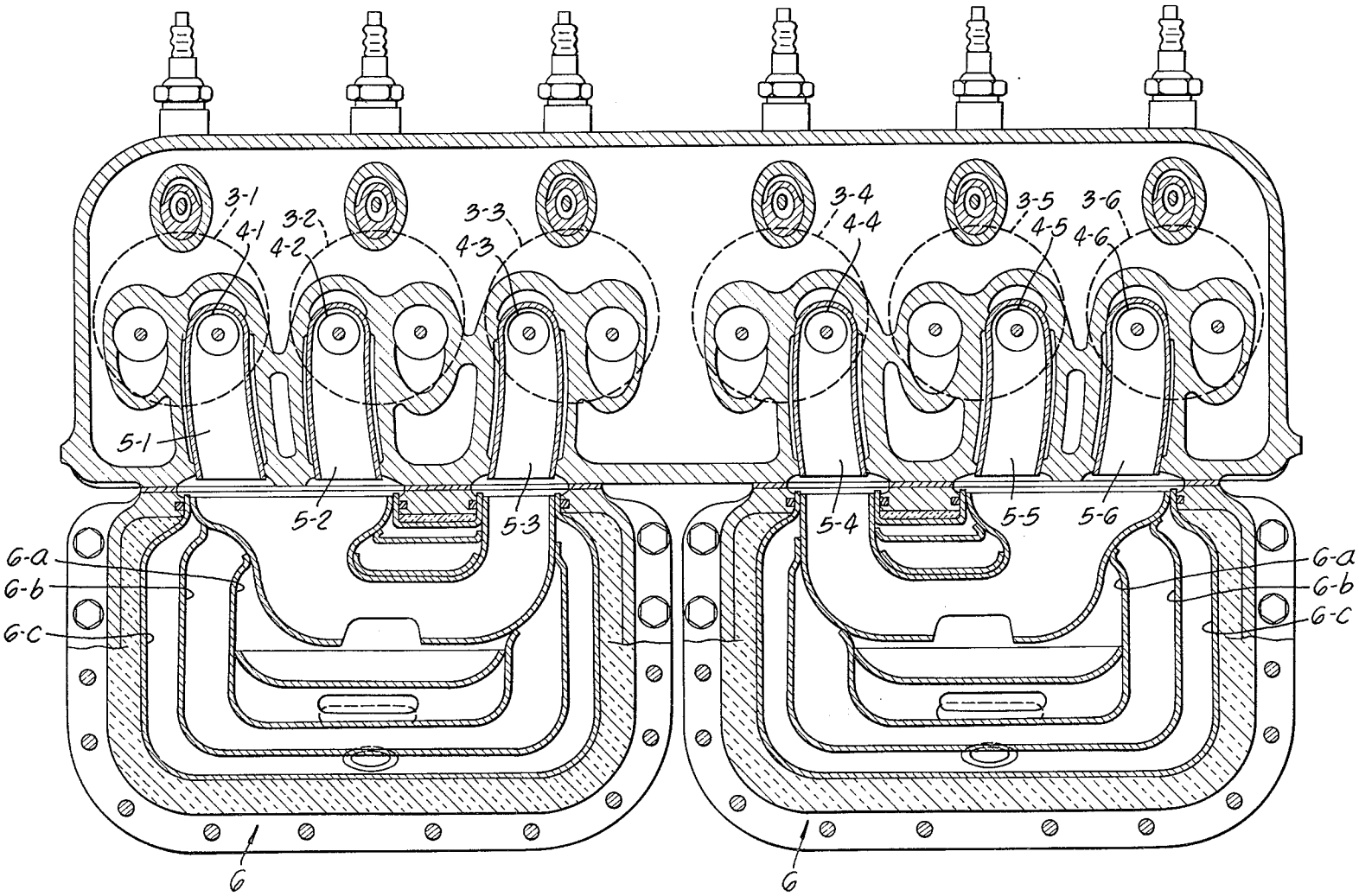
FIG. 4 is a cross-sectional view taken about line 4—4 of FIG. 3.

Referring now to FIGS. 3 and 4, the specific embodiment of the present invention will be described in detail. A six cylinder in line engine generally referred to as 2, is provided with six combustion chambers 3. These combustion chambers 3 are divided into two groups of three in line combustion chambers labeled 3-1, 3-2 and 3-3 in the first group of three in line combustion chambers, and labeled 3-4, 3-5 and 3-6 in the second group of three combustion chambers.

Exhaust valve ports 4-1 and 4-3 of the flanking combustion chambers 3-1 and 3-3 of the first group of three in line combustion chambers are positioned such that they are near or close to the side of the middle or central combustion chamber 3-2 thereby reducing the length of exhaust passages 5-1, 5-2 and 5-3. Similarly, in the second group of three adjacent in line combustion chambers, exhaust valve ports 4-4 and 4-6 are installed on the side of the middle or central combustion chamber 3-5. The exhaust passages of the second group of three combustion chambers, 5-4, 5-5 and 5-6 meet and are connected to an exhaust reaction chamber means 6. Similarly, the exhaust passages 5-1, 5-2 and 5-3 are connected to an exhaust reaction chamber means 6.

As shown in FIG. 4, exhaust passages 5-1 and 5-2 are joined prior to joining exhaust passage 5-3; similarly, exhaust passages 5-5 and 5-6 are joined prior to joining the exhaust passage 5-4. In a preferred embodiment, the exhaust reaction chamber means 6 comprises three annular reaction chambers *6a*, *6b* and *6c* connected in series. Such a construction allows a configuration having the shortest distance through the respective exhaust passages so that the confluence of the three exhaust passages from each of the first and second groups of three adjacent combustion chambers may be of a reduced length and surface area in order to minimize radiation heat transfer.

Figure 6:
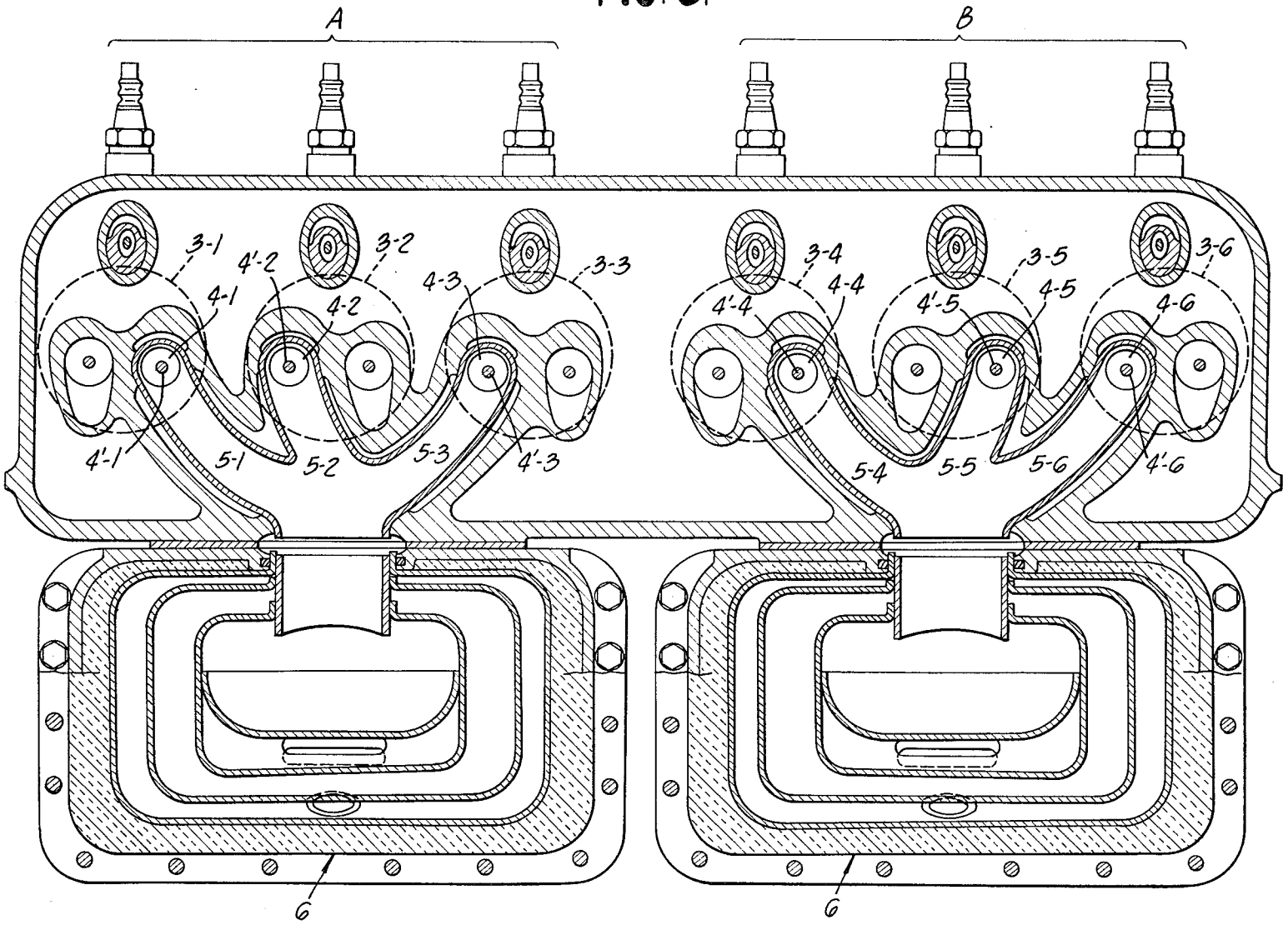
FIG. 6 is a cross-sectional view taken about line 6—6 of FIG. 5.

As shown in FIG. 6, all three exhaust passages from each group of the three adjacent combustion chambers may be positioned in order to meet within the engine 2 prior to being connected to the exhaust reaction chamber means 6. This arrangement allows for a further decrease in the length of the exhaust passageways and their attendant surface areas.

Figure 8:
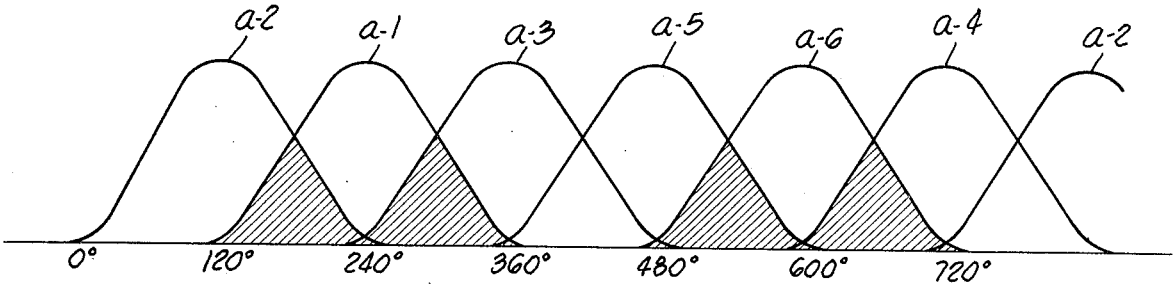
FIG. 8 is a diagram illustrating the relation between the periods of exhaust valve openings of the present invention.
Figure 9:
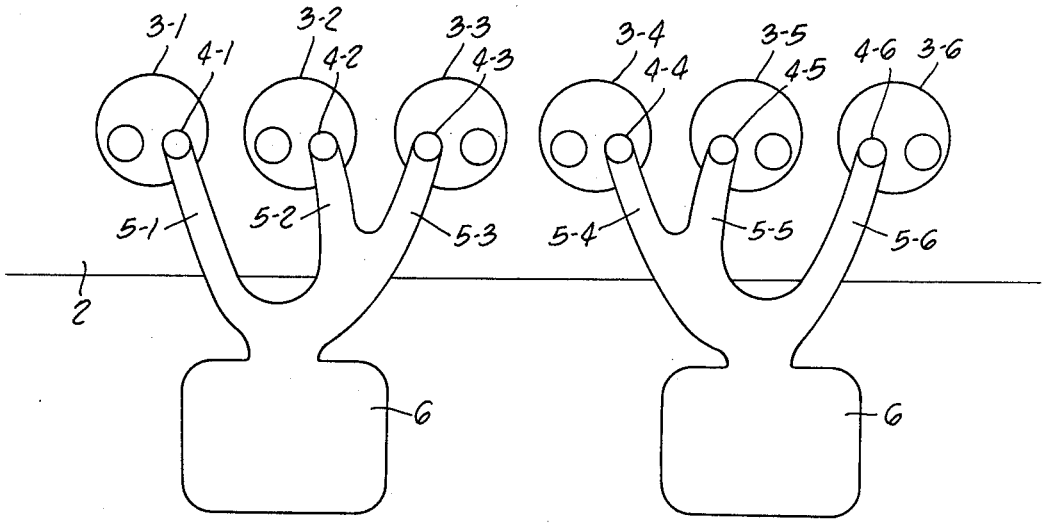
FIGS. 9 and 10 are schematic representations illustrating embodiments of the present invention.
Figure 10:
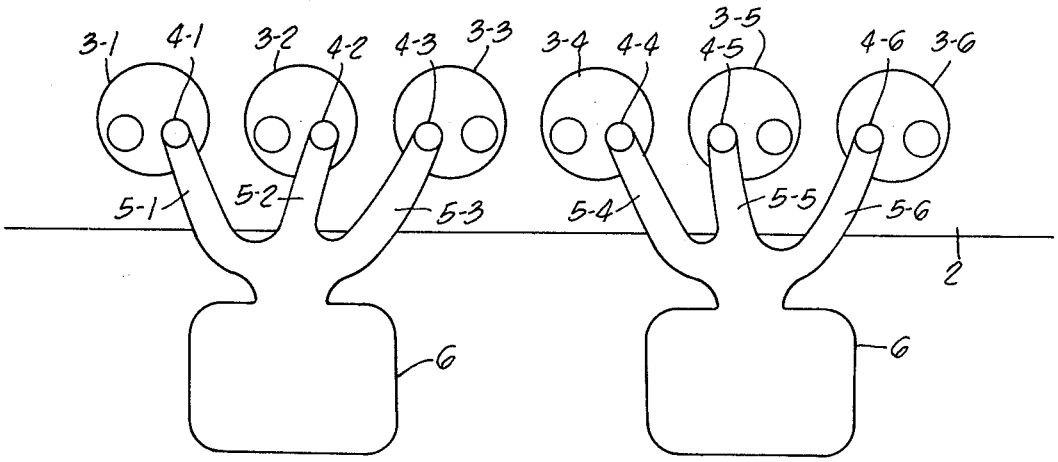

As illustrated in FIG. 7, the firing order of the combustion chambers may be controlled by ignition timing means such that the combustion chambers are fired in the order of the combustion chambers 3-2, 3-1 and 3-3 in the first group of three adjacent combustion chambers and in the order of 3-5, 3-6 and 3-4 in the second group of three adjacent combustion chambers with phase intervals of 120° in reference to the crank shaft rotation. Further, FIG. 8 illustrates in graph form, the opening of consecutive exhaust valve ports which may be controlled by exhaust valve port opening means such that the period of valve openings of the sequentially fired combustion chambers overlap partially as shown by the portions cross-hatched in FIG. 8.

Thus, for example, in the first group of three adjacent combustion chambers, the exhaust gas of relatively low temperature discharged into the exhaust passage 5-2 at or near the end of the exhaust stroke when the exhaust valve 4'-2 opens is joined with the exhaust gas of high temperature discharged into the exhaust passage 5-1 at or near the beginning of the exhaust stroke when the exhaust valve 5'-1 opens sequentially in order to maintain an overall high exhaust temperature. Similar exhaust valve opening overlap is accomplished by controlling in a similar manner exhaust valves 4'-1 and 4'-3, 4'-5 and 4'-6, and 4'-6 and 4'-4.

In each group of three in-line combustion chambers, the exhaust valve ports of the side or flanking combustion chambers are positioned on the side of that cylinder which is closest to the middle or central combustion chamber in comparison with the intake valve ports thereof.

Having described the invention, it will be apparent to those skilled in the art that additional forms thereof may be employed. For example, the foregoing embodiment illustrates a configuration wherein each of the first and second groups of three adjacent combustion chambers are provided with an exhaust reaction chamber thus requiring two reaction chambers. In engines of the type that arrange two groups of combustion chambers in a V or horizontally opposite configuration, it will be sufficient to provide a single common exhaust reaction chamber in the middle of the two groups, connecting the exhaust passages of each group to the common exhaust reaction chamber. Accordingly, it is the inventor's intent to be limited only by the scope of the appended claims.

We claim:

1. A six cylinder internal combustion engine having first and second groups of three in-line combustion chambers, each of the groups having a central combustion chamber and two flanking combustion chambers, one on each side of the central combustion chamber, each combustion chamber having an intake valve port and an exhaust valve port, each of the exhaust valve ports of the flanking combustion chambers being positioned adjacent the central combustion chamber, exhaust reaction chamber means, and first and second confluence members joining said exhaust valve ports of said first and second groups to said exhaust reaction chamber means, respectively.

2. The six cylinder internal combustion engine claimed in claim 1 further comprising ignition means for controlling the order of each of said first and second groups of three adjacent combustion chambers such that the ignition in each group of three adjacent combustion chambers is successive, and exhaust valve opening means for controlling the opening of said exhaust valve ports such that the periods of successive exhaust valve port openings partially overlap.

3. The six cylinder internal combustion engine claimed in claim 1 wherein said first and second confluence members are further defined as including an exhaust passage from each exhaust valve port of said first and second groups of three adjacent combustion chambers, respectively, said exhaust passages being joined within said internal combustion engine.

4. The six cylinder internal combustion engine claimed in claim 2 wherein said first and second confluence members are further defined as including an exhaust passage from each exhaust valve port of said first and second groups of three adjacent combustion chambers, respectively, said exhaust passages being joined within said internal combustion engine.

5. The six cylinder internal combustion engine claimed in claim 1 wherein said exhaust reaction chamber means is further defined as including first and second exhaust reaction chambers joined to said first and second group of three adjacent combustion chambers by said first and second confluence members, respectively.

6. A six cylinder internal combustion engine having first and second groups of three in-line combustion chambers, each of the groups having a central combustion chamber and two flanking combustion chambers, one on each side of the central combustion chamber, each combustion chamber having an intake valve port and an exhaust valve port, each of the exhaust valve ports of the flanking combustion chambers being positioned adjacent the central combustion chamber, exhaust reaction chamber means, and first and second confluence members joining said exhaust valve ports of said first and second groups to said exhaust reaction chamber means, respectively and said first and second confluence members being further defined as including an exhaust passage from each exhaust valve port of said first and second groups of three adjacent combustion chambers, respectively, said exhaust passages being joined within said internal combustion engine.

7. A method of operating a six cylinder internal combustion engine having first and second groups of three in-line combustion chambers, each of the groups having a central combustion chamber and two flanking combustion chambers, one on each side of the central combustion chamber, each combustion chamber having an intake valve port and an exhaust valve port, each of the exhaust valve ports of the flanking combustion chambers being positioned adjacent the central combustion chamber, exhaust reaction chamber means, and first and second confluence members joining said exhaust valve ports of said first and second groups to said exhaust reaction chamber means, respectively, comprising: igniting an air-fuel mixture in each of said first and second groups of three adjacent combustion chambers of said first and second groups of three adjacent combustion chambers in order, such that the ignition in each group of three adjacent combustion chambers is successive; and opening said exhaust valve ports such that the periods of successive exhaust port openings partially overlap.

8. The method of operating a six cylinder internal combustion engine claimed in claim 7 further comprising: joining exhaust gas streams exiting said exhaust valve ports within said engine.

9. The method of operating a six cylinder internal combustion engine claimed in claim 7 wherein the successive igniting of said combustion chambers is further defined as igniting the combustion chambers at phase intervals of 120° in reference to the crank shaft rotation.

10. A six cylinder internal combustion engine having first and second groups of three adjacent combustion chambers, each group of combustion chambers consisting of a middle combustion chamber and two side combustion chambers; an intake valve port and an exhaust valve port connected to each of said six combustion chambers, in each group of three adjacent combustion chambers the exhaust valve port of each side combustion chamber being positioned on the side of its combustion chamber which is closest to the middle combustion chamber, an exhaust reaction chamber means; first and second confluence members joining said exhaust valve ports of said first and second groups of three adjacent combustion chambers to said exhaust reaction chamber means, respectively; ignition means for controlling the order of each of said first and second groups of three adjacent combustion chambers such that the ignition in each group of three adjacent combustion chambers is successive; and exhaust valve opening means for controlling the opening of said exhaust valve ports such that the periods of successive exhaust valve port openings partially overlap, said first and second confluence members are further defined as including an exhaust passage from each exhaust valve port of said first and second groups of three adjacent combustion chambers, respectively, said exhaust passages being joined within said internal combustion engine.

11. The six cylinder internal combustion engine claimed in claim 8 wherein said exhaust reaction chamber means is further defined as including first and second exhaust reaction chambers joined to said first and second groups of three adjacent combustion chambers by said first and second confluence members, respectively.

12. A six cylinder internal combustion engine having first and second groups of three adjacent combustion chambers, each group of combustion chambers consisting of a middle combustion chamber and two side combustion chambers; an intake valve port and an exhaust valve port connected to each of said six combustion chambers, in each group of three adjacent combustion chambers the exhaust valve port of each side combustion chamber being positioned on the side of its combustion chamber which is closest to the middle combustion chamber; first and second exhaust reaction chamber; first and second confluence members joining said exhaust valve ports of said first and second groups of three adjacent combustion chambers to said first and second groups of three adjacent combustion chambers such that the ignition in each group of three adjacent combustion chambers is successive; and exhaust valve ports such that the periods of successive exhaust valve port openings partially overlap, said first and second confluence members being further defined as including an exhaust passage from each exhaust valve port of said first and second groups of three adjacent combustion chambers, respectively, said exhaust passages being joined within said internal combustion engine.

13. An in-line six cylinder internal combustion engine having first and second groups of three adjacent combustion chambers, each group of combustion chambers consisting of a middle combustion chamber and two side combustion chambers; an intake valve port and an exhaust valve port connected to each of said six combustion chambers, in each group of three adjacent combustion chambers the exhaust valve port of each side combustion chamber being positioned on the side of its combustion chamber which is closest to the middle combustion chamber; an exhaust reaction chamber means; and first and second confluence members joining said exhaust valve ports of said first and second groups of three adjacent combustion chambers to said exhaust reaction chamber means, respectively, each of said first and second confluence members including a first connecting means for connecting the exhaust valve port of the combustion chamber at one end of the in-line six combustion chambers and the exhaust valve port of the middle combustion chamber in said each group, a second connecting means for connecting said first connecting means and the exhaust valve port of the remainder combustion chamber in said each group and a third connecting means for connecting said second connecting means to said exhaust reaction chamber means.

14. An in-line six cylinder internal combustion engine having first and second groups of three adjacent combustion chambers, each group of combustion chambers consisting of a middle combustion chamber and two side combustion chambers; an intake valve port and an exhaust valve port connected to each of said six combustion chambers, the exhaust valve port of each side combustion chamber being positioned on the side of its combustion chamber which is closest to the middle combustion chamber, an exhaust reaction chamber means, first and second confluence members joining said exhaust valve ports of said first and second groups of three adjacent combustion chambers to said exhaust reaction chamber means including a first connecting means for connecting the exhaust valve port of the combustion chamber at one end of the in-line six combustion chamber in said each group, a second connecting means for connecting said first connecting means and the exhaust valve port of the remainder combustion chamber in said each group and a third connecting means for connecting said second connecting means to said exhaust reaction chamber means; ignition means for controlling the order of each of said first and second groups of three adjacent combustion chambers such that the ignition in each group of the combustion chamber at one end of the in-line six combustion chamber and the middle combustion chamber in said each group is successive; and exhaust valve opening means for controlling the opening of said exhaust valve opening means for controlling the opening of said exhaust valve ports such that the periods of successive exhaust valve port openings partially overlap.

* * * * *